US006364684B1

(12) United States Patent
Kameyama

(10) Patent No.: US 6,364,684 B1
(45) Date of Patent: Apr. 2, 2002

(54) CONNECTOR LOCKING MECHANISM

(75) Inventor: Isao Kameyama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/514,326

(22) Filed: Feb. 28, 2000

(30) Foreign Application Priority Data

Feb. 26, 1999 (JP) ..... 11-051078

(51) Int. Cl.[7] ..... H01R 13/627
(52) U.S. Cl. ..... 439/354; 439/668
(58) Field of Search ..... 439/357, 350, 439/345, 578, 607–620, 354, 385

(56) References Cited

U.S. PATENT DOCUMENTS

| | | | | | |
|---|---|---|---|---|---|
| 4,333,699 | A | * | 6/1982 | Brorein | 439/592 |
| 4,449,776 | A | * | 5/1984 | Carmo et al. | 439/350 |
| 4,548,455 | A | * | 10/1985 | Ezure | 439/357 |
| 4,824,402 | A | * | 4/1989 | Sorimachi | 439/680 |
| 6,033,260 | A | * | 3/2000 | Murata et al. | 439/578 |

FOREIGN PATENT DOCUMENTS

| | | | |
|---|---|---|---|
| JP | 10-223317 | 8/1998 | H01R/13/648 |

* cited by examiner

*Primary Examiner*—Khiem Nguyen
*Assistant Examiner*—Javaid Nasri
(74) *Attorney, Agent, or Firm*—Sughrue Mion, PLLC

(57) ABSTRACT

A connector locking mechanism (1) includes lock projections (4), formed respectively at distal ends of resilient piece portions (3) provided at an outer peripheral portion of a male connector (2) (for connecting shielded wires (W1, W2) together), and springs (5) which are resiliently deformable radially, the lock projections (4) and the springs (5) projecting radially outwardly from the outer peripheral surface of the male connector (2). When the male connector (2) is connected to a female connector (21), the lock projections (4) are engaged in a lock groove (23) formed in an inner peripheral surface of a jack sleeve (22) of the female connector (21), thereby locking or holding the male connector (2) and the female connector (21) in a mutually-connected condition, and also the springs (5) are held against the inner peripheral surface of the jack sleeve (22). A plurality of ribs (16) are formed respectively on those portions of the outer peripheral surface of the male connector (2) disposed adjacent respectively to the lock projections (4), and each of the ribs (16) has a slanting surface (17) which is slanting forwardly downwardly in a fitting direction.

7 Claims, 5 Drawing Sheets

CONNECTOR LOCKING MECHANISM

BACKGROUND OF THE INVENTION

1. Field of the Invention

The present invention relates to a locking mechanism of connectors for interconnecting shielded wires used for electrically connecting a plug and a jack of an antenna in an audio equipment or the like mounted on an automobile or the like.

The present application is based on Japanese Patent Application No. Hei. 11-51078, which is incorporated herein by reference.

2. Description of the Related Art

Various locking mechanisms for connectors, used for connecting shielded wires together, have heretofore been known, and FIGS. 4 and 5 show one such example.

As shown in FIG. 4, the related connector locking mechanism 51 includes lock projections 54, formed respectively at distal ends of resilient piece portions 53 provided at an outer peripheral portion of a male connector 52 (which is used for connecting shielded wires W1 and W2 of an antenna plug and an antenna jack together), and springs 55 which are resiliently deformable radially of the male connector 52, the lock projections 54 and the springs 55 projecting radially outwardly from the outer peripheral surface of the male connector 52. When the male connector 52 and a female connector 71 are connected together, the lock projections 54 are engaged in a lock groove 73 formed in an inner peripheral surface of a jack sleeve 72 of the female connector 71, thereby locking or holding the male connector 52 and the female connector 71 in a mutually-connected condition, and also the springs 55 are held against the inner peripheral surface of the jack sleeve 72, so that the shield connection is effected.

More specifically, a male terminal 56 of a round rod-like shape, provided at a front end of the male connector 52, is supported in a male housing 57 made of a non-electrically-conductive material such as nylon, and a shield member 58 is fitted on the male housing 57. A plurality of axially-elongated notches are formed in the shield member 58 except a front end portion thereof, and a rear end portion of this shield member 58 is bent radially outwardly to provide the springs 55 and the resilient piece portion 53. As described above, the lock projection 54 is formed on an outer surface of the resilient piece portion 53 at the rear end thereof.

A shield braid-clamping portion 59 and a wire clamping portion 60 are disposed rearwardly of the shield member 58, and a shield braid 61 is clamped by the shield braid-clamping portion 59, and the shielded wire W1 is clamped by the wire clamping portion 60. A conductor 62 extends from the front end of the shielded wire W1, and is fixedly connected to the distal end of the male terminal 56.

An axially-slidable slide member 63, made of a synthetic resin, is fitted on the outer peripheral surface of the shield member 58 to cover the same. Notches 64 and 65 are formed in the slide member 63, and the resilient piece portions 53 can project outwardly from the slide member 63 through the respective notches 64, and the springs 55 can project outwardly from the slide member 63 through the respective notches 65.

The female connector 71 includes a female terminal 74 provided at an axis thereof, and this female terminal 74 has a connecting spring 75 formed integrally therewith, and this connecting spring 75 is pressed against the male terminal 56, thereby electrically connecting the female terminal 74 to the male terminal 56. An L-shaped metal member 76, formed integrally with the female terminal 74, is fixedly connected to a conductor 77 of the female-side shielded wire W2. The female terminal 74 is fitted in a female housing 78 of a tubular shape made of a non-electrically-conductive material such as nylon, and this female housing 78 is covered with the jack sleeve 72 serving as a shield member. A shield braid-clamping portion 79 and a wire clamping portion 80 are disposed rearwardly of the jack sleeve 72, and a shield braid 61 is clamped by the shield braid-clamping portion 79, and the shielded wire W2 is clamped by the wire clamping portion 80.

The lock groove 73 is formed in the inner surface of the jack sleeve 72 at the front end thereof, and the lock projections 54 can be engaged in this lock groove 73. The outer surface of the jack sleeve 72 is covered with an insulative outer tube 81 made of a synthetic resin.

In the connector locking mechanism 51 of the above construction, the rear portion of the slide member 63 of the male connector 52 and the insulative outer tube 81 of the female connector 71 are held with the hands, respectively, and then the male connector 52 is inserted into the female connector 71. As a result, the male terminal 56 is brought into contact with the connecting spring 75 of the female terminal 74, and therefore is electrically connected thereto. At the same time, the resilient piece portions 53 are resiliently deformed, so that the lock projections 54 are engaged in the lock groove 73, thereby locking the male connector 52 to the female connector 71.

The springs 55 are pressed against the inner surface of the jack sleeve 72, and therefore the male-side shield member 58 is electrically connected to the jack sleeve 72 serving as the female-side shield member, so that the male connector 52 and the female connector 71, thus connected together, are shielded. The female and male connectors have the insulative outer tube 81 and the slide member 63 (both of which is made of a non-electrically-conductive material), respectively, each serving as an outer covering member, and therefore even when other electrode, wire or the like accidentally contacts these connectors, the short-circuiting will not occur.

For canceling the mutually-connected condition of the male and female connectors 52 and 71, the slide member 63 and the insulative outer tube 81 are held with the hands, respectively, and are moved away from each other, so that the slide member 63 is first moved slightly in the disconnecting direction. As a result, the front end (edge) of each notch 64 presses the corresponding resilient piece portion 53 toward the axis of the male connector 52, thereby disengaging the corresponding lock projection 54 from the lock groove 73, and at the same time the front end (edge) of each notch 65 brings the corresponding spring 55 out of contact with the inner surface of the jack sleeve 72. Therefore, when the two connectors are further moved away from each other, the whole of the male connector 52 is completely disconnected from the female connector 71, so that the male terminal 56 is disengaged from the female terminal 74, thus completing the disconnecting operation.

In the above connector locking mechanism 51, however, the springs 55 of the male connector 52 are held against the inner surface of the jack sleeve 72, and therefore a gap is formed between the slide member 63 of the male connector 52 and the jack sleeve 72.

Therefore, when the male connector 52 is forced into gouging relation to the female connector 71 to be inclined, for example, at an angle a within the jack sleeve 72 at the time of canceling the locked condition, the lock projections 54 are firmly fitted in the lock groove 73, which results in a problem that the locked condition can not be canceled.

SUMMARY OF THE INVENTION

With the above problem in view, it is an object of the present invention to provide a connector locking mechanism in which even if a pair of connectors, connected together in a fitted manner, are forcibly inclined relative to each other, a force, required for disconnecting the two connectors from each other, will not increase, and also a force of fitting between the two connectors, will not decrease.

To achieve the above object, according to the first aspect of the present invention, there is provided a connector locking mechanism which comprises a plurality of lock members provided at an outer periphery of a first connector connected to a first shielded wire, a plurality of resilient members provided at the outer periphery of the first connector, the resilient members being resilient in a radial direction of the first connector, a groove formed in an inner peripheral surface of a second connector connected to a second shielded wire, wherein when the first connector is fitted relative to the second connector, the lock members are engaged in the groove of the second connector, and the resilient members are held against the inner peripheral surface of the second connector, and a plurality of ribs formed on the outer peripheral surface of the first connector, wherein when the first connector is fitted relative to the second connector, the ribs are held in contact with the inner peripheral surface of the second connector.

In the connector locking mechanism of the above construction, when the two connectors are connected together, the ribs are held in contact with the inner peripheral surface of the second connector, and therefore the two connectors are positively prevented from being brought into gouging relation to each other by an external force as produced by vibrations. Therefore, the disconnecting force, required when disconnecting the two connectors from each other, will not increase, and also the force of fitting between the two connectors will not decrease. Therefore, the efficiency of the connector fitting and disconnecting operations is enhanced, and besides the reliability of the two connectors is enhanced.

According to the second aspect of the present invention, it is preferable that the plurality of ribs have slanting surfaces, and wherein when the first connector is fitted relative to the second connector, the slanting surfaces of the ribs are held in contact with the inner peripheral surface of the second connector.

According to the third aspect of the present invention, it is preferable that the first connector is a male connector, and the second connector is a female connector.

According to the forth aspect of the present invention, it is preferable that the lock members are lock projections which are respectively formed on distal ends of resilient piece portions provided at the outer periphery of the first connector, and the resilient members are leaf-like springs. Further, according to the fifth aspect of the present invention, it is preferable that the lock projections and the leaf-like springs project radially outwardly from the outer periphery of the first connector.

According to the sixth aspect of the present invention, it is preferable that the connector locking mechanism further comprises a jack sleeve disposed in the second connector, wherein the groove is formed in an inner peripheral surface of the jack sleeve, and wherein when the first connector is fitted relative to the second connector, the lock members are engaged in the groove of the jack sleeve, and the resilient members are held against the inner peripheral surface of the jack sleeve.

According to the seventh aspect of the present invention, it is preferable that the plurality of ribs are respectively formed on portions of the outer peripheral surface of the first connector adjacent respectively to the lock members.

According to the eighth aspect of the present invention, it is preferable that the plurality of ribs have slanting surfaces which are slanted forwardly downwardly in a fitting direction of the first connector to the second connector. Accordingly, when the two connectors are fitted together, these ribs are held in contact with the inner peripheral surface of the jack sleeve, and therefore the two connectors are positively prevented from being brought into gouging relation to each other by an external force as produced by vibrations. Therefore, the disconnecting force, required when disconnecting the two connectors from each other, will not increase, and also the force of fitting between the two connectors will not decrease. Therefore, the efficiency of the connector fitting and disconnecting operations is enhanced, and besides the reliability of the two connectors is enhanced.

DETAILED DESCRIPTION OF THE PREFERRED EMBODIMENT

Figure 1:
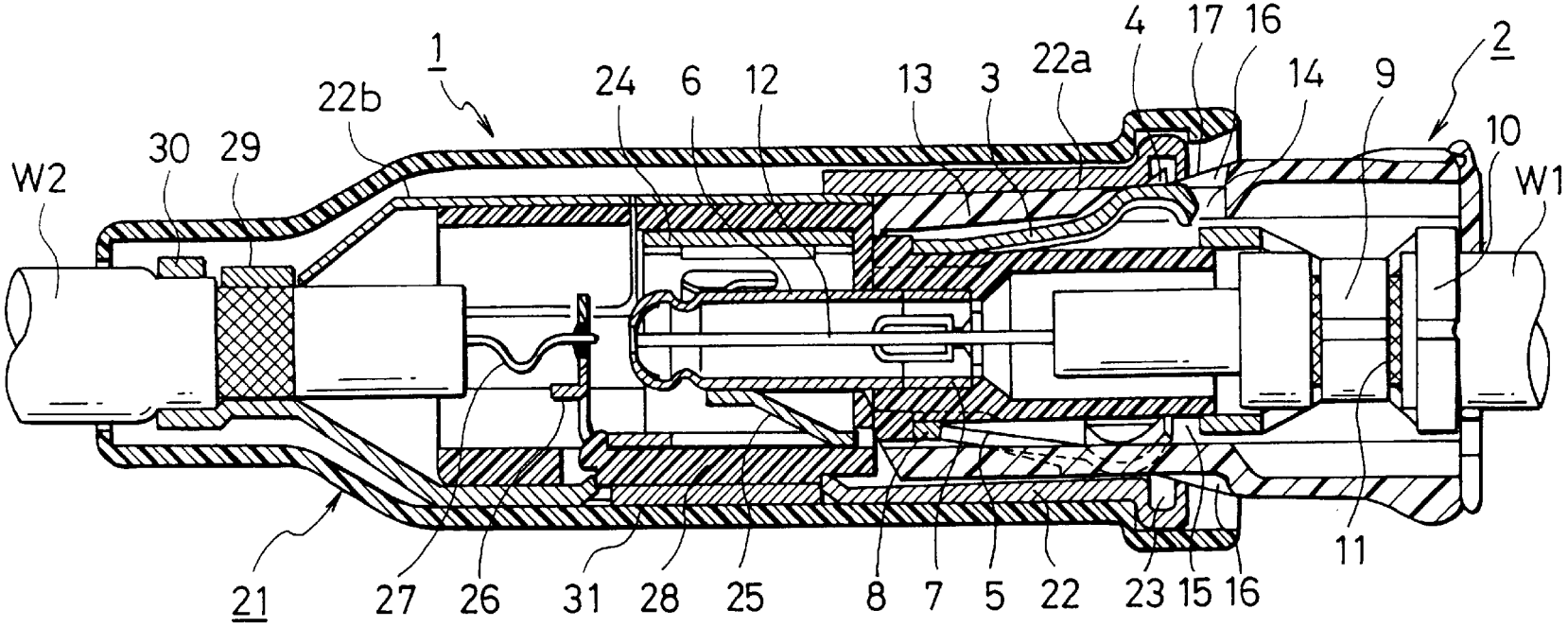
FIG. 1 is a longitudinal cross-sectional view of one preferred embodiment of a connector locking mechanism of the present invention.
Figure 2:
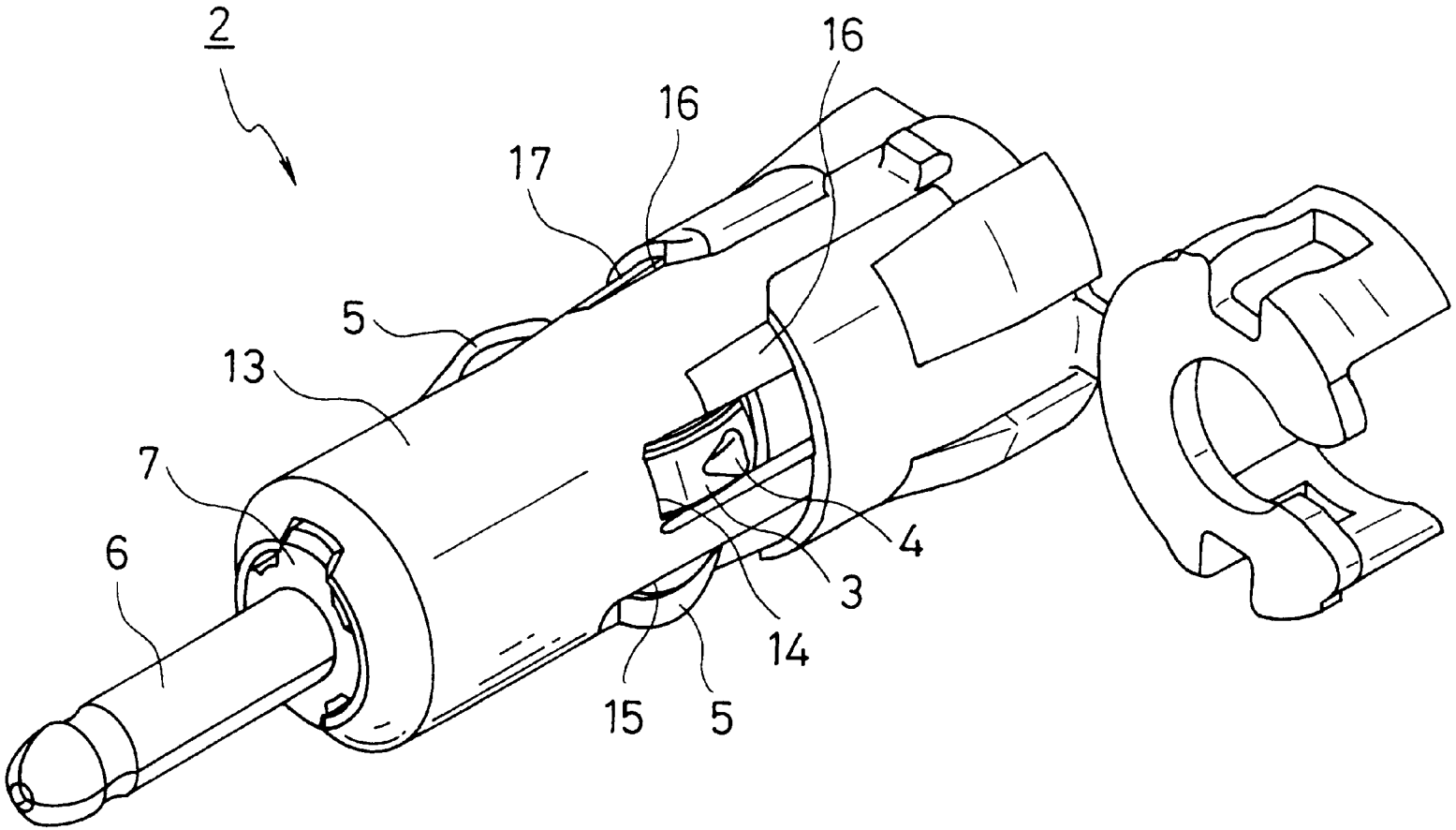
FIG. 2 is a perspective view of a male connector in FIG. 1.
Figure 3:
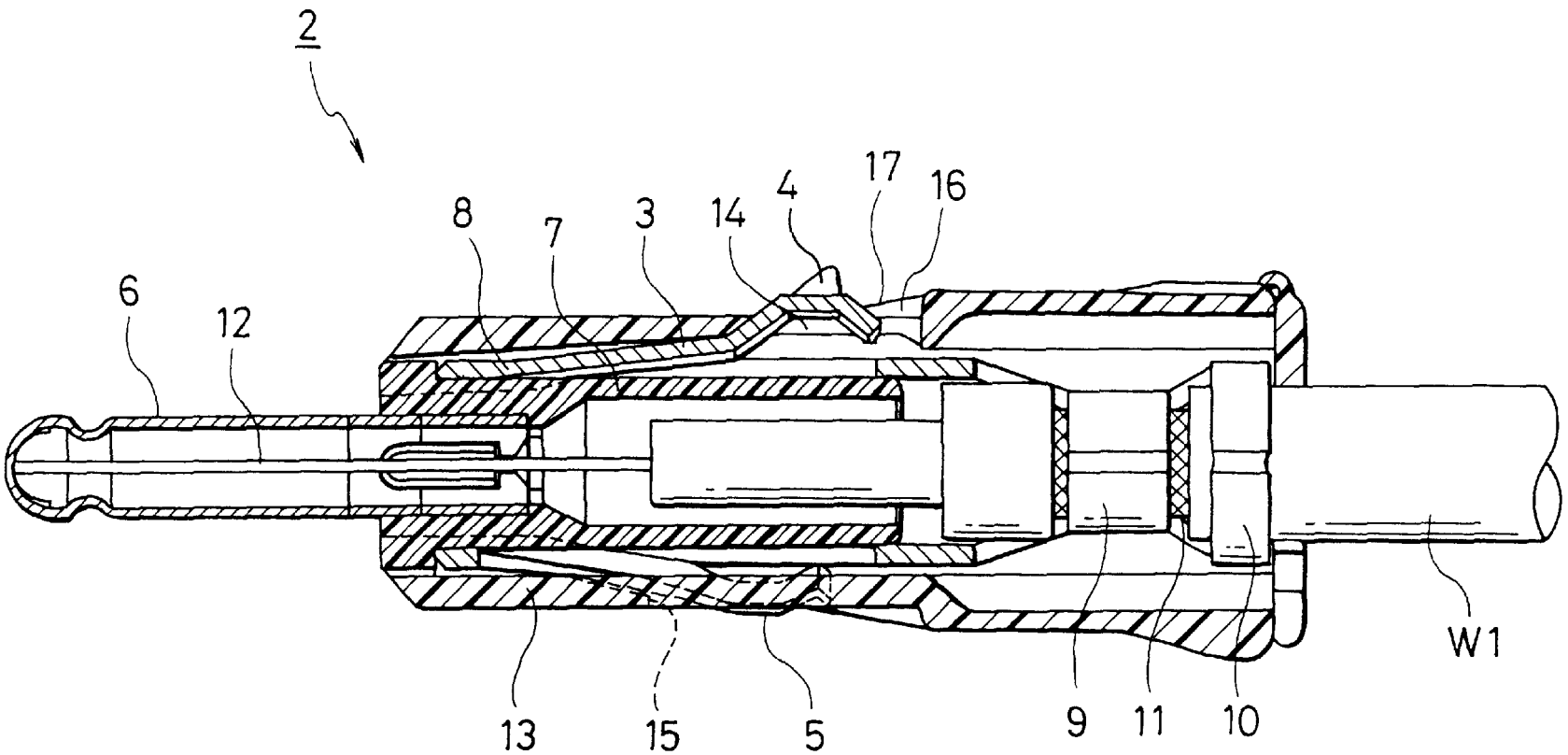
FIG. 3 is a longitudinal cross-sectional view of the male connector.
Figure 4:
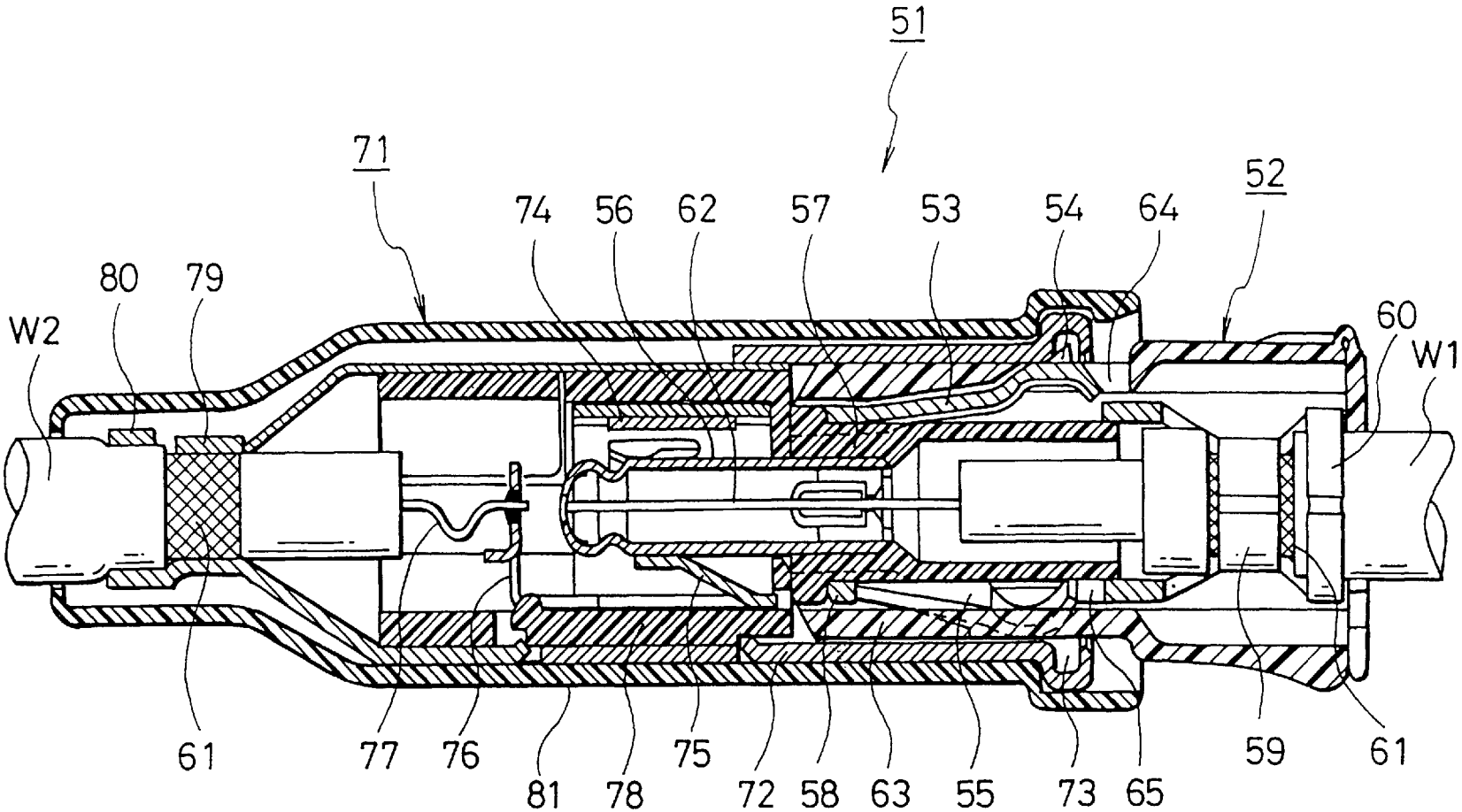
PRIOR ART FIG. 4
FIG. 4 is a longitudinal cross-sectional view of a related connector locking mechanism.
Figure 5:
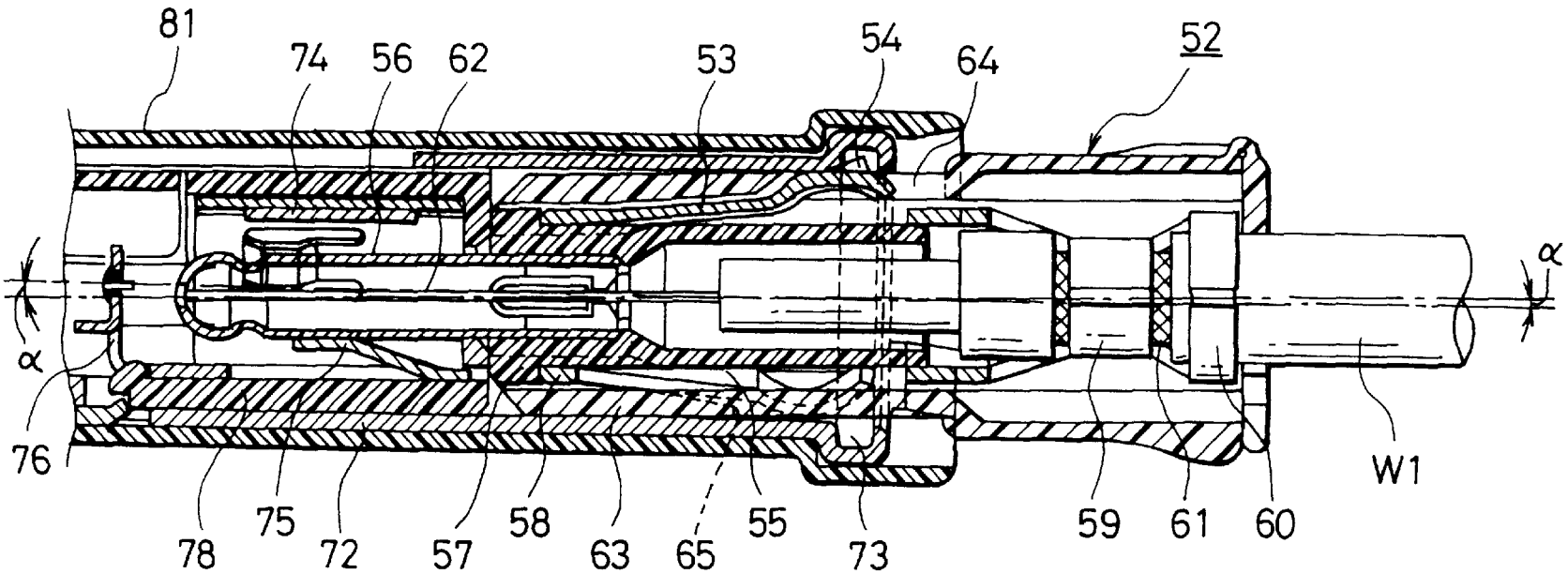
PRIOR ART FIG. 5
FIG. 5 is a view explanatory of an operation of the connector locking mechanism of FIG. 4.

One preferred embodiment of a connector locking mechanism of the present invention will now be described in detail with reference to FIGS. 1 to 3. FIG. 1 is a longitudinal cross-sectional view of the connector locking mechanism of this embodiment, FIG. 2 is a perspective view of a male connector in FIG. 1, and FIG. 3 is a longitudinal cross-sectional view of the male connector.

The connector locking mechanism 1 of this embodiment includes lock projections 4, formed respectively at distal ends of resilient piece portions 3 provided at an outer peripheral portion of the male connector 2 (for connecting shielded wires W1 and W2 of an antenna plug and an antenna jack together), and springs 5 which are resiliently deformable radially of the male connector 2, the lock projections 4 and the springs 5 projecting radially outwardly from the outer peripheral surface of the male connector 2. When the male connector 2 is connected to a female connector 21, the lock projections 4 are engaged in a lock groove 23 formed in an inner peripheral surface of a jack sleeve 22 of the female connector 21, thereby locking or holding the male connector 2 and the female connector 21 in a mutually-connected condition, and also the springs 5 are held against the inner peripheral surface of the jack sleeve 22, so that the shield connection is effected.

More specifically, a male terminal 6 of a round rod-like shape, provided at a front end of the male connector 2, is supported in a male housing 7 made of a non-electrically-conductive material such as nylon, and a shield member 8 is fitted on the male housing 7. A plurality of axially-elongated notches are formed in the shield member 8 except a front end portion thereof, and a rear end portion of this shield member 8 is bent radially outwardly to provide the springs 5 and the resilient piece portion 3. As described above, the lock projection 4 is formed on an outer surface of the resilient piece portion 3 at the rear end thereof.

A shield braid-clamping portion 9 and a wire clamping portion 10 are disposed rearwardly of the shield member 8, and a shield braid 11 is clamped by the shield braid-clamping portion 9, and the shielded wire WI is clamped by the wire clamping portion 10. A conductor 12 extends from the front end of the shielded wire W1, and is fixedly connected to the distal end of the male terminal 6, for example, by soldering.

An axially-slidable slide member 13, made of a synthetic resin, is fitted on the outer peripheral surface of the shield member 8 to cover the same. Notches 14 and 15 are formed in the slide member 13, and the resilient piece portions 3 can project outwardly from the slide member 13 through the respective notches 14, and the springs 5 can project outwardly from the slide member 13 through the respective notches 15.

A feature of this embodiment resides in the fact that a plurality of ribs 16 are formed respectively at those portions of the slide member 13 disposed adjacent respectively to the lock projections 4 provided at the outer periphery of the male connector 2, each of the ribs 16 having a slanting surface 17 slanting forwardly downwardly in the fitting direction.

The female connector 21 includes a female terminal 24 provided at an axis thereof, and this female terminal 24 has a connecting spring 25 formed integrally therewith, and this connecting spring 25 is pressed against the male terminal 6, thereby electrically connecting the female terminal 24 to the male terminal 6. An L-shaped metal member 26, formed integrally with the female terminal 24, is fixedly connected to a conductor 27 of the female-side shielded wire W2, for example, by soldering.

The female terminal 24 is fitted in a female housing 28 of a tubular shape made of a non-electrically-conductive material such as nylon, and this female housing 28 is covered with the jack sleeve 22 serving as a shield member. A shield braid-clamping portion 29 and a wire clamping portion 30 are disposed rearwardly of the jack sleeve 22, and a shield braid is clamped by the shield braid-clamping portion 29, and the shielded wire W2 is clamped by the wire clamping portion 30.

The lock groove 23 is formed in the inner surface of the jack sleeve 22 at the front end thereof, and the lock projections 4 can be engaged in this lock groove 23. The outer surface of the jack sleeve 22 is covered with an insulative outer tube 31 made of a synthetic resin.

In the connector locking mechanism 1 of the above construction, the rear portion of the slide member 13 of the male connector 2 and the insulative outer tube 31 of the female connector 21 are held with the hands, respectively, and then the male connector 2 is inserted into the female connector 21. As a result, the male terminal 6 is brought into contact with the connecting spring 25 of the female terminal 24, and therefore is electrically connected thereto. At the same time, the resilient piece portions 3 are resiliently deformed, so that the lock projections 4 are engaged in the lock groove 23, thereby locking the male connector 2 to the female connector 21.

The springs 5 are pressed against the inner surface of the jack sleeve 22, and therefore the male-side shield member 8 is electrically connected to the jack sleeve 22 serving as the female-side shield member, so that the male connector 2 and the female connector 21, thus connected together, are shielded.

And besides, the female and male connectors have the insulative outer tube 31 and the slide member 13 (both of which is made of a non-electrically-conductive material), respectively, each serving as an outer covering member, and therefore even when other electrode, wire or the like contacts these connectors, the short-circuiting will not occur.

A characteristic operation of the connector locking mechanism 1 of this embodiment is that when the pair of male and female connectors 2 and 21 are connected together, the slanting surfaces 17 of the plurality of ribs 16 are brought into contact with the inner peripheral surface of the jack sleeve 22 at the front end thereof (where the lock groove 23 is provided), so that the axes of the two connectors 2 and 21 coincide with each other in the vicinity of a region where the lock projections 4 are disposed.

At this time, each rib 16 will not interfere with the adjacent notch 14 for the lock projection 4 since the rib 16 is disposed out of registry with the notch 14 in the circumferential direction, and therefore the lock projections 4 are engaged in the lock groove 23 with a generally-uniform contact pressure, and also the springs 5 are held against the inner peripheral surface of the jack sleeve 22 with a generally uniform pressure, and thus the contact pressures of the lock projections 4, as well as the contact pressures of the springs 5, will not much differ from one another.

For canceling the mutually-connected condition of the male and female connectors 2 and 21 so as to disconnect them from each other, the slide member 13 and the insulative outer tube 31 are held with the hands, respectively, and are moved away from each other, so that the slide member 13 is first moved slightly in the disconnecting direction. As a result, the front end (edge) of each notch 14 presses the corresponding resilient piece portion 3 toward the axis of the male connector 2, thereby disengaging the corresponding lock projection 4 from the lock groove 23, and at the same time the front end (edge) of each notch 15 brings the corresponding spring 5 out of contact with the inner surface of the jack sleeve 22.

Therefore, when the two connectors are further moved away from each other, the whole of the male connector 2 is completely disconnected from the female connector 21, so that the male terminal 6 is disengaged from the female terminal 24, thus completing the disconnecting operation.

As described above, in the connector locking mechanism 1 of this embodiment, the plurality of ribs 16, each having the slanting surface 17 which is slanting forwardly downwardly in the fitting direction, are formed respectively on those portions of the outer peripheral surface of the male connector 2 disposed adjacent respectively to the lock projections 4. Therefore, when the two connectors 2 and 21 are fitted together, the ribs 16 are held in contact with the inner peripheral surface of the front end of the jack sleeve 22, and therefore the two connectors 2 and 21 will not be brought into gouging relation to each other by an external force as produced by vibrations. Therefore, the disconnecting force, required when disconnecting the two connectors from each other, will not increase, and also the force of fitting between the two connectors will not decrease. Therefore, the efficiency of the operations, required for fitting and disconnecting the two connectors 2 and 21 relative to each other, is enhanced, and besides the reliability of the two connectors is enhanced.

As described above, in the connector locking mechanism of the present invention, the plurality of tapering ribs are formed on the outer peripheral surface of the connector, and when the connector is fitted in the mating connector, these ribs are held in contact with the inner peripheral surface of the mating connector, and therefore the two connectors are positively prevented from being brought into gouging relation to each other by an external force as produced by vibrations.

Therefore, the disconnecting force, required when disconnecting the two connectors from each other, will not increase, and also the force of fitting between the two connectors will not decrease. Therefore, the efficiency of the connector fitting and disconnecting operations is enhanced, and besides the reliability of the two connectors is enhanced.

The plurality of ribs are formed respectively on those portions of the outer peripheral surface of the male connector disposed adjacent respectively to the lock projections, and each of the ribs has the slanting surface which is slanting forwardly downwardly in the fitting direction. Therefore, when the two connectors are fitted together, these ribs are held in contact with the inner peripheral surface of the female connector, and therefore the two connectors are positively prevented from being brought into gouging relation to each other by an external force as produced by vibrations.

Therefore, the efficiency of the connector fitting and disconnecting operations is enhanced, and besides the reliability of the two connectors is enhanced.

What is claimed is:

1. A connector locking mechanism, comprising:

a plurality of lock members provided at an outer periphery of a first connector connected to a first shielded wire;

a plurality of resilient members provided at the outer periphery of the first connector, the resilient members being resilient in a radial direction of the first connector;

a groove formed in an inner peripheral surface of a second connector connected to a second shielded wire, wherein when the first connector is fitted relative to the second connector, the lock members are engaged in the groove of the second connector, and the resilient members are held against the inner peripheral surface of the second connector; and a plurality of ribs formed on the outer peripheral surface of the first connector, said ribs having slanting surfaces slanting forwardly downwardly in a fitting direction of the first connector to the second connector, wherein when the first connector is fitted relative to the second connector, the ribs are held in contact with the inner peripheral surface of the second connector to maintain angular position of the second connector with respect to the first connector.

2. The connector locking mechanism of claim 1, wherein when the first connector is fitted relative to the second connector, the slanting surfaces of the ribs are held in contact with the inner peripheral surface of the second connector.

3. The connector locking mechanism of claim 1, wherein the first connector is a male connector, and the second connector is a female connector.

4. The connector locking mechanism of claim 1, wherein the lock members are lock projections which are respectively formed on distal ends of resilient piece portions provided at the outer periphery of the first connector, and the resilient members are leaf-like springs.

5. The connector locking mechanism of claim 4, wherein the lock projections and the leaf-like springs project radially outwardly from the outer periphery of the first connector.

6. The connector locking mechanism of claim 1, further comprising a jack sleeve disposed in the second connector, wherein the groove is formed in an inner peripheral surface of the jack sleeve, and wherein when the first connector is fitted relative to the second connector, the lock members are engaged in the groove of the jack sleeve, and the resilient members are held against the inner peripheral surface of the jack sleeve.

7. The connector locking mechanism of claim 1, wherein the plurality of ribs are respectively formed on portions of the outer peripheral surface of the first connector adjacent respectively to the lock members.

* * * * *